US009431024B1

(12) United States Patent
Hsu

(10) Patent No.: US 9,431,024 B1
(45) Date of Patent: Aug. 30, 2016

(54) METHOD AND APPARATUS FOR DETECTING NOISE OF AUDIO SIGNALS

(71) Applicant: Faraday Technology Corp., Hsinchu (TW)

(72) Inventor: Chung-Chi Hsu, Hsinchu (TW)

(73) Assignee: Faraday Technology Corp., Hsin-Chu (TW)

( * ) Notice: Subject to any disclaimer, the term of this patent is extended or adjusted under 35 U.S.C. 154(b) by 0 days.

(21) Appl. No.: 14/731,432

(22) Filed: Jun. 5, 2015

(30) Foreign Application Priority Data

Mar. 2, 2015 (TW) ..... 104106484 A

(51) Int. Cl.

| | |
|---|---|
| ***G10L 21/02*** | (2013.01) |
| ***G10L 21/034*** | (2013.01) |
| ***G10L 19/02*** | (2013.01) |
| ***G10L 21/0264*** | (2013.01) |
| ***G10L 21/0232*** | (2013.01) |

(52) U.S. Cl.
CPC ..... *G10L 21/034* (2013.01); *G10L 19/0212* (2013.01); *G10L 21/0232* (2013.01); *G10L 21/0264* (2013.01)

(58) Field of Classification Search
None
See application file for complete search history.

(56) References Cited

U.S. PATENT DOCUMENTS 6,549,884 B1 * 4/2003 Laroche ..... G10L 21/003 704/203
8,731,915 B2 * 5/2014 Shin ..... H03G 3/32 704/225
9,159,336 B1 * 10/2015 Yang ..... G10L 21/0208
2004/0167773 A1 * 8/2004 Sorin ..... G10L 25/90 704/207
2005/0058301 A1 * 3/2005 Brown ..... G10L 21/0208 381/94.2
2006/0155537 A1 * 7/2006 Park ..... G10L 25/78 704/243
2012/0253812 A1 10/2012 Kalinli et al.
2013/0287225 A1 * 10/2013 Niwa ..... H04R 3/00 381/92
2014/0350927 A1 * 11/2014 Yamabe ..... G10L 21/0232 704/233
2016/0104490 A1 * 4/2016 Sukowski ..... G10L 19/0212 704/501
2016/0155456 A1 * 6/2016 Wang ..... G10L 25/81 704/208

* cited by examiner

*Primary Examiner* — Thang Tran
(74) *Attorney, Agent, or Firm* — Winston Hsu; Scott Margo

(57) ABSTRACT

A method and an apparatus for detecting noise of audio signals are provided. The method includes steps of converting an audio signal into a plurality of audio frames, where the audio frames are arranged in chronological order while taking a target frame as a center, calculating a plurality of magnitudes respectively corresponding to a plurality of spectral components of each of the audio frames, calculating differences between the adjacent magnitudes in a time-frequency domain to obtain a plurality of difference values in at least two directions orthogonal to each other in the time-frequency domain, where the time-frequency domain is defined by the audio frames, determining a maximum degree of difference of the magnitudes in the time-frequency domain according to the difference values, and determining whether a part of the audio signal corresponding to the target frame is a noise according to the maximum degree of difference.

24 Claims, 5 Drawing Sheets

METHOD AND APPARATUS FOR DETECTING NOISE OF AUDIO SIGNALS

CROSS-REFERENCE TO RELATED APPLICATION

This application claims the priority benefit of Taiwan application serial no. 104106484, filed on Mar. 2, 2015. The entirety of the above-mentioned patent application is hereby incorporated by reference herein and made a part of this specification.

BACKGROUND

1. Technical Field

The invention relates to a method and an apparatus for processing audio signals, and particularly relates to a method and an apparatus for detecting noise of audio signals.

2. Related Art

Generally, when audio signals of voice or music are processed, a background noise in the audio signals is first detected. The background noise is also referred to as messy noise or white noise, which is unnecessary noise and required to be removed from the audio signals. There are three solutions for estimating the white noise.

A first solution is to track a signal strength of the audio signal by calculation of moving average, and then estimate the noise in the audio signal according to a change of energy magnitude. However, such method cannot estimate noise energy in real-time, and if the noise is varied dramatically, an estimating result is probably inaccurate. A second solution is to use entropy statistics, though a computation amount of such method is huge, and a time length of the statistics may influence the accuracy of the noise estimation, and is hard to be determined. A third solution is to use a model comparison, though accuracy of an estimation result thereof is highly correlated to a voice training material, such that the estimation result of the noise is hard to be controlled.

SUMMARY

The invention is directed to a method and an apparatus for detecting noise of audio signals, which are capable of accurately detecting a noise in the audio signals, and are adapted to a dramatic change of the noise.

The invention provides a method for detecting noise of audio signals, which includes following steps. An audio signal is converted into a plurality of audio frames, where the audio frames are arranged in a chronological order while taking a target frame as a center. A plurality of magnitudes respectively corresponding to a plurality of spectral components of each of the audio frames are calculated. Differences between the adjacent magnitudes in a time-frequency domain are calculated to obtain a plurality of difference values in at least two directions orthogonal to each other in the time-frequency domain, where the time-frequency domain is defined by the audio frames. A maximum degree of difference of the magnitudes in the time-frequency domain is determined according to the difference values. It is determined whether a part of the audio signal corresponding to the target frame is a noise according to the maximum degree of difference.

The invention provides an apparatus for detecting noise of audio signals, which includes a storage device and a processor. The processor is coupled to the storage device, stores the aforementioned magnitudes to the storage device, and executes the aforementioned method for detecting noise of audio signals.

According to the above descriptions, according to the method and the apparatus for detecting noise of audio signals of the invention, the noise in the audio signals is quickly detected through simple computation, and effective and accurate detection can be implemented even in case of a dramatic change of the noise.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

In an embodiment of the invention, regarding a processing procedure of audio signals, a method for quickly and accurately detecting a background noise is provided, by which an audio signal is converted to a frequency domain to obtain spectrum information, and a plurality of magnitudes on the spectrum are spread into a time-frequency domain according to time intervals and frequency bands. In the time-frequency domain, differences between the magnitudes are calculated according to orthogonal directions, so as to obtain a maximum degree of difference. According to a characteristic that the energy of the background noise is almost the same within a short period of time, when the maximum degree of difference is still smaller than a predetermined threshold, a target frame corresponding to the maximum degree of difference is determined to be a noise segment in the audio signal. Compared to the conventional technique of calculating the energy change before the current frame, in the embodiment of the invention, by counting spectrum information within a period of time before and after the target frame, the noise detection may be more accurate. Moreover, since only simple operation instructions are used, it avails decreasing a computation amount to achieve quick detection. In addition, considering a low signal-to-noise ratio (SNR), a two-dimensional (2D) low-pass filtering operation may be performed to the time-frequency domain formed by spreading the magnitudes, so as to further improve the accuracy of the noise detection through multiple frequency resolution.

Figure 1:
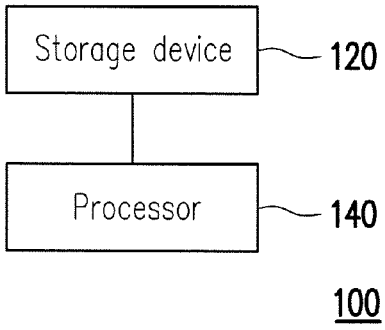
FIG. 1 is a schematic diagram of an apparatus for detecting noise of audio signals according to an embodiment of the invention.

FIG. 1 is a schematic diagram of an apparatus for detecting noise of audio signals according to an embodiment of the invention. The noise detection apparatus 100 includes a storage device 120 and a processor 140. The processor 140 is coupled to the storage device 120. The processor 140 may execute a method for detecting noise of audio signals shown in FIG. 2 to FIG. 7, so as to quickly and accurately detect the noise in the audio signals. The audio signal is, for example, a digital signal generated by performing an analog-to-digital conversion to an analogy type original audio signal. The original audio signal may be a voice instruction received from a user through a microphone, or an audio signal sent by an electronic device such as a television, a CD player, etc. The noise is, for example, a background white noise or a colored noise (such as a red noise, etc.) that has a stronger magnitude in a specific frequency band. Moreover, the processor 140, for example, performs the analog-to-digital conversion by using pulse-code modulation (PCM). The storage device 120 may store the above audio signal and various value and data generated or required by the aforementioned method.

Figure 2:
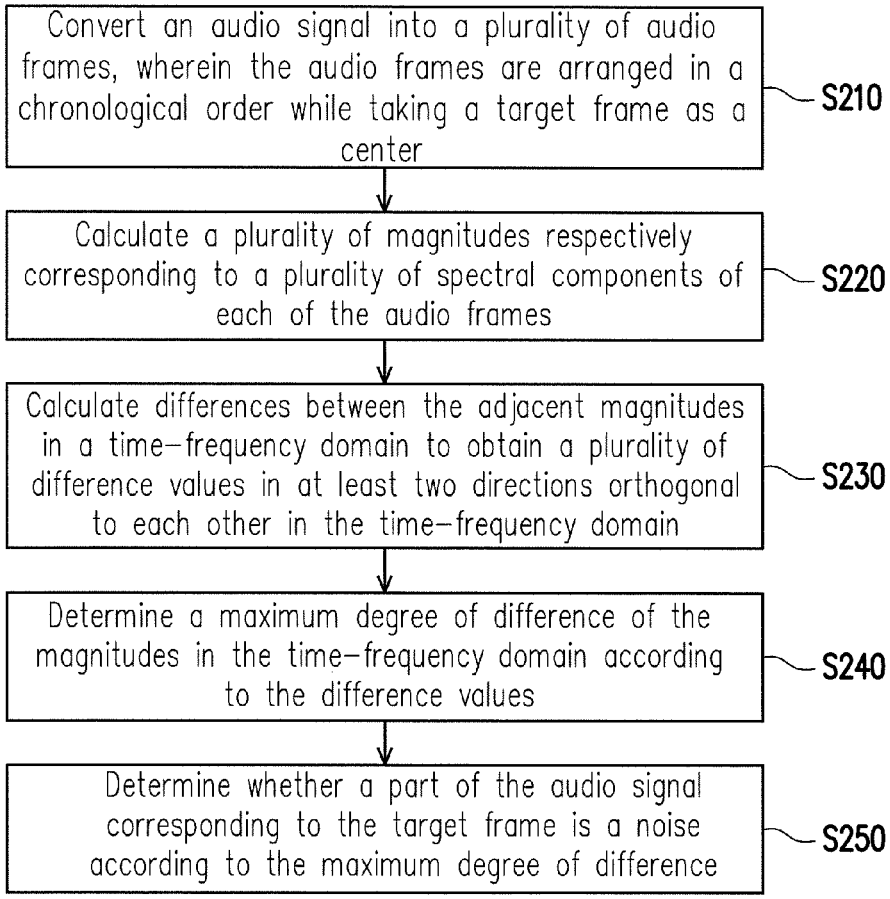
FIG. 2 is a flowchart illustrating a method for detecting noise of audio signals according to an embodiment of the invention.

FIG. 2 is a flowchart illustrating a method for detecting noise of audio signals according to an embodiment of the invention. The processor 140 executes the flow shown in FIG. 2 to each audio frame in the audio signal. If the audio frame on which the processor 140 executes the noise detect is referred to as a current frame, the processor 140 obtains spectrum information corresponding to the current frame and the audio frames in the adjacent several time intervals, so as to determine whether the current frame is a noise segment in the audio signal.

The flow of FIG. 2 is described below. First, in step S210, the processor 140 converts an audio signal into a plurality of audio frames, where the audio frames are arranged in a chronological order while taking a target frame as a center. The audio frames includes the target frame and several other audio frames within a period of time before and after the target frame, and are used for providing the related spectrum information required for detecting whether the target frame is the noise in the follow-up steps.

In step S220, the processor 140 calculates a plurality of magnitudes respectively corresponding to a plurality of spectral components of each of the audio frames. In detail, the processor 140, for example, applies fast Fourier transform (FFT) to obtain a spectrum of each audio frame for analysis. The spectrum may include a plurality of spectral components, and each spectral component includes a real part and an imaginary part. The processor 140 calculates a sum of a square of the real part and a square of the imaginary part of each spectral component, and then calculates a square root thereof to obtain an absolute value of each spectral component, and takes the absolute value as the magnitude of each spectral component.

Therefore, through the flow of the steps S210-S220, the processor 140 may convert the audio signal to a frequency domain, and obtain spectrum information of each audio frame and the magnitude of each spectral component. The processor 140 may spread the magnitudes into a plane to form a 2D time-frequency domain according to time intervals and frequency bands respectively determined by the audio frames and the spectral components. In other words, the time-frequency domain may be defined by the audio frames, where a time axis of the time-frequency domain may be determined according to a time sequence of sampling the aforementioned audio frames, and a frequency axis of the time-frequency domain may be determined according to a plurality of the spectral components of sampling the audio frames. The processor 140 may store the magnitudes in the time-frequency domain to the storage device 120.

In step 230, the processor 140 calculates differences between the adjacent magnitudes in the time-frequency domain to obtain a plurality of difference values in at least two directions orthogonal to each other in the time-frequency domain. Then, in step S240, the processor 140 determines a maximum degree of difference of the magnitudes in the time-frequency domain according to the difference values.

Further, the processor 140, for example, performs a gradient operation or a first-order differential operation to the adjacent magnitudes in the time-frequency domain to obtain a variation between the magnitudes. The processor 140 may calculate components of the gradient in the directions orthogonal to each other in the time-frequency domain, so as to use a proportion relationship between the gradient components in the orthogonal directions to represent the maximum degree of difference of the magnitudes in the time-frequency domain. In brief, by using the orthogonal directions, indicative information of the overall magnitudes in the time-frequency domain may be effectively extracted, such that the processor 140 may represent the differences between all of the magnitudes in the time-frequency domain by using a magnitude variation in the orthogonal directions.

It should be noticed that according to the characteristic that the energy of the background noise is almost the same within a short period of time, those skilled in the art can easily understand that variations of the adjacent magnitudes of the noise on the two directions orthogonal to each other in the time-frequency domain are almost the same. Therefore, if the processor 140 calculates the variations of the magnitudes according to the two directions orthogonal to each other, the obtained maximum degree of difference is greater than 1 and is close to 1. Therefore, in step S250, the processor 140 determines whether a part of the audio signal corresponding to the target frame is a noise according to the maximum degree of difference calculated in the aforementioned step. For example, the processor 140 may set a threshold used for identifying a lowest energy magnitude corresponding to a valid signal, and when the aforementioned maximum degree of difference is lower than the threshold, the processor 140 may determine that the part of the audio signal corresponding to the target frame is the noise.

In this way, in the present embodiment, it is only required to perform simple computations in the two orthogonal directions in the time-frequency domain, and the maximum degree of difference of the magnitudes of the target frame in the two orthogonal directions is calculated, so as to determine the noise. Particularly, since the above calculation flow considers the correlation between data, the situation of losing information when probability is used to calculate a degree of entropy in the conventional technique is avoided. Moreover, in the present embodiment, since statistics is applied to analyze the spectrum information, the detection result is not liable to be influenced by other factors to have a fluctuation, and the detection result may be directly compared with the selected threshold. In this way, the noise in the audio signal may be quickly and effectively detected.

Figure 3:
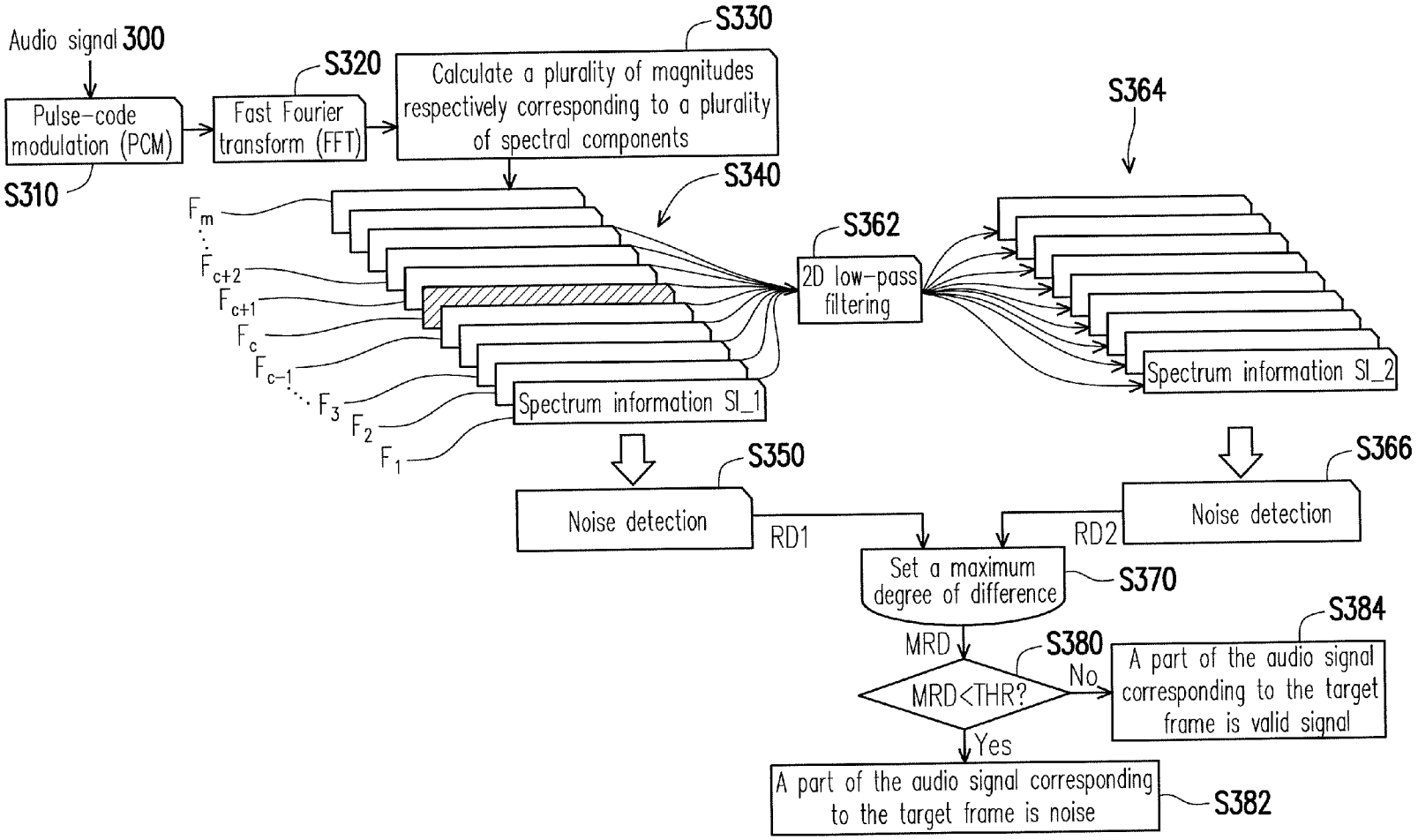
FIG. 3 and FIG. 4 are schematic diagrams of a method for detecting noise of audio signals according to an embodiment of the invention.

Another embodiment is provided below for description. FIG. 3 is a schematic diagram of a method for detecting noise of audio signals according to an embodiment of the invention. In step S310, the noise detection apparatus 100 receives an audio signal 300 of an analog format, and performs PCM to the audio signal 300 to obtain the audio signal 300 of a digital format. In other embodiments, the noise detection apparatus 100 may directly receive the audio signal 300 of the digital format, so that the above step S310 may be omitted.

In step S320, the processor 140 converts the audio signal 300 of the digital format into a plurality of audio frames, and perform a FFT to each of the audio frames to convert the audio signal 300 of the time domain to the frequency domain. In step S330, the processor 140, for example, calculates a sum of a square of the real part and a square of the imaginary part of each spectral component of each audio frame, and then calculates a square root thereof to obtain an absolute value of each spectral component, and takes the absolute value as the magnitude of each spectral component. Such magnitude may be used for representing an energy strength corresponding to each spectral component.

Then, in step S340, the processor 140 stores the magnitudes into the storage device 120. It should be noticed that the storage device 120, for example, includes a ring buffer, which is used for storing the related spectrum information required when the processor 140 performs noise detection to a target frame $F_c$. The related spectrum information may include spectrum information of the target frame $F_c$ and the adjacent audio frames, for example, a magnitude of each spectral component of the target frame $F_c$, a magnitude of each spectral component of a plurality of audio frames $F_1$, $F_2$, . . . , $F_{c-1}$ within a period of time before the target frame $F_c$, and a magnitude of each spectral component of a plurality of audio frames $F_{c+1}$, $F_{c+2}$, $F_m$ within a period of time after the target frame $F_c$. In the present embodiment, the above m audio frames $F_1$, $F_2$, $F_3$, . . . , $F_c$, . . . , $F_m$ are arranged in a chronological order while taking the target frame $F_c$ as a center, and the processor 140 may sequentially store the spectrum information (for example, the spectrum information SI_1 corresponding to the audio frame $F_1$ shown in FIG. 3) of each audio frame into the ring buffer of the storage device 120 according to the time intervals respectively corresponding to the aforementioned audio frames. Moreover, along with the change of the target frame $F_c$, the above spectrum information stored by the ring buffer of the storage device 120 is also updated.

Then, in step S350, the processor 140 determines whether a part of the audio signal 300 corresponding to the target frame $F_c$ is a noise according to the spectrum information stored in the ring buffer of the storage device 120.

Figure 4:
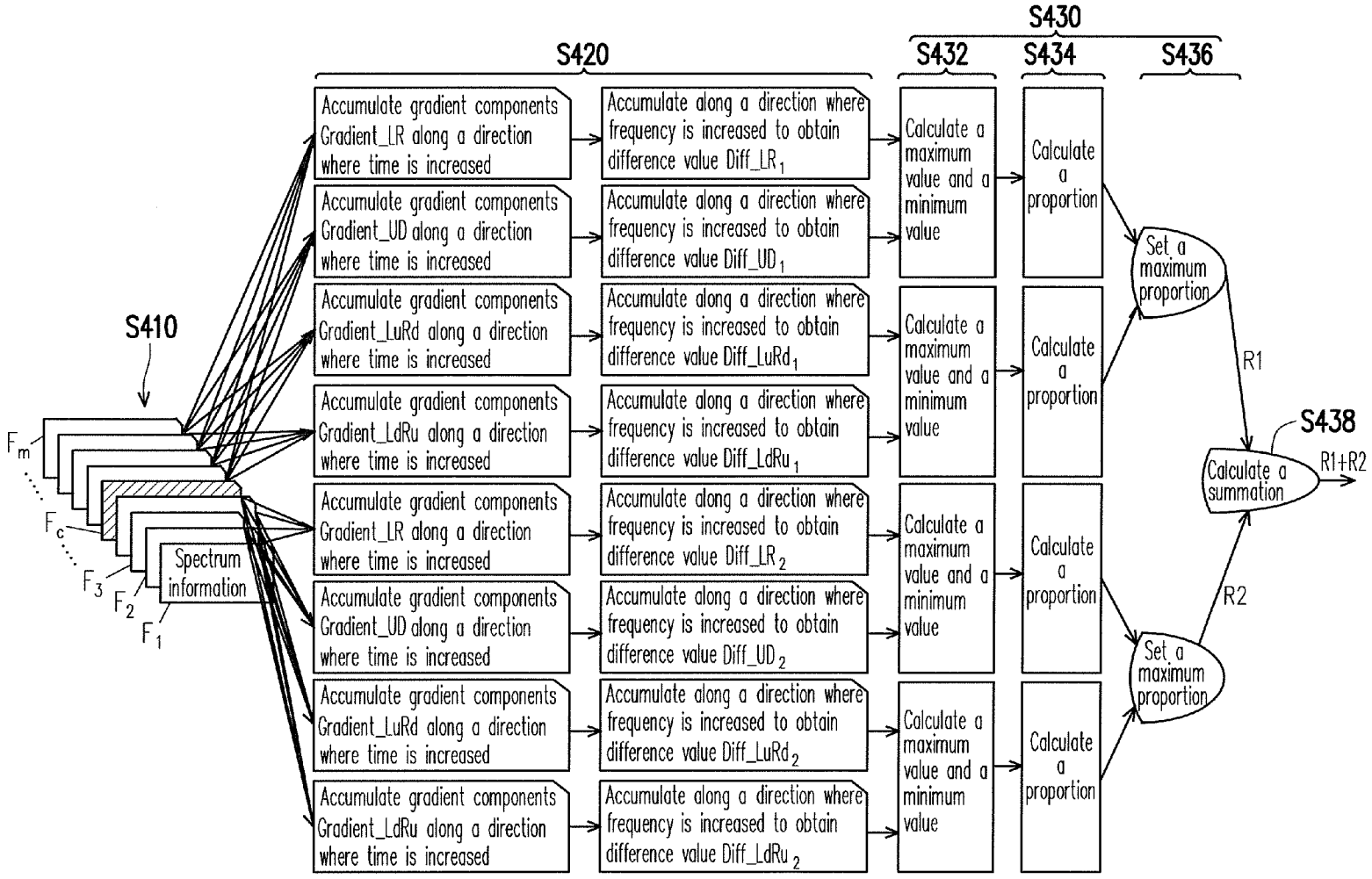

FIG. 4 is a schematic diagram of a method for detecting noise of audio signals according to an embodiment of the invention, which is a detailed flow of the aforementioned step S350 that the processor 140 determines whether a part of the audio signal 300 corresponding to the target frame $F_c$ is the noise.

Figure 5:
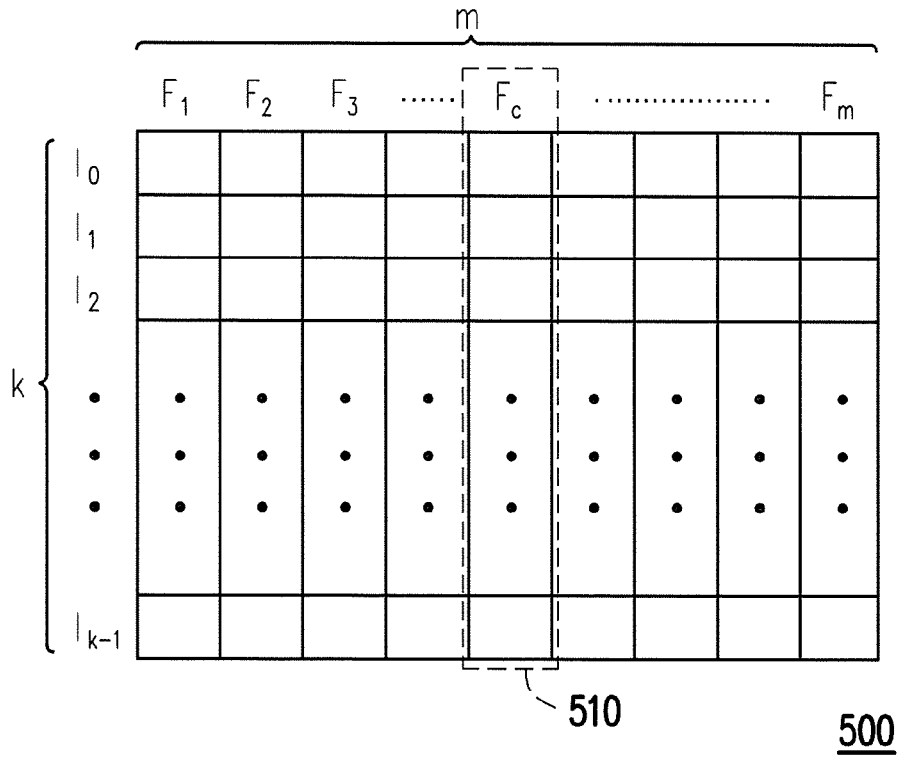
FIG. 5, FIG. 6 and FIG. 7 are schematic diagrams for calculating differences between a plurality of adjacent magnitudes in a time-frequency domain according to an embodiment of the invention.

First, in step S410, the processor 140 obtains the spectrum information related to the target frame $F_c$. In the present embodiment, the processor 140, for example, obtains a plurality of magnitudes of the m audio frames $F_1$, $F_2$, $F_3$, . . . , $F_c$, . . . , $F_m$ that take the target frame $F_c$ as a center on the frequency domain of the FFT. The processor 140 spreads the magnitudes into a plane according to time intervals and frequency bands, so as to form a 2D time-frequency domain. As shown in FIG. 5, the processor 140 may spread the magnitudes into an m×k time-frequency domain 500 according to m audio frames $F_1$, $F_2$, $F_3$, . . . , $F_c$, . . . , $F_m$ and k spectral components $I_0$, $I_1$, $I_2$, . . . , $I_{k-1}$. The above m×k dimension may be regarded as a resolution of the noise detection performed to the audio signal 300. In an example, m is 9 and k is 128. The spectrum information 510 shown in FIG. 5, for example, includes the magnitudes of each spectral component of the target audio $F_c$.

Then, in step S420, the processor 140 determines at least two directions orthogonal to each other in the time-frequency domain 500, and calculates differences between the adjacent magnitudes in the time-frequency domain 500, so as to obtain a plurality of difference values in the at least two directions orthogonal to each other.

Figure 6:
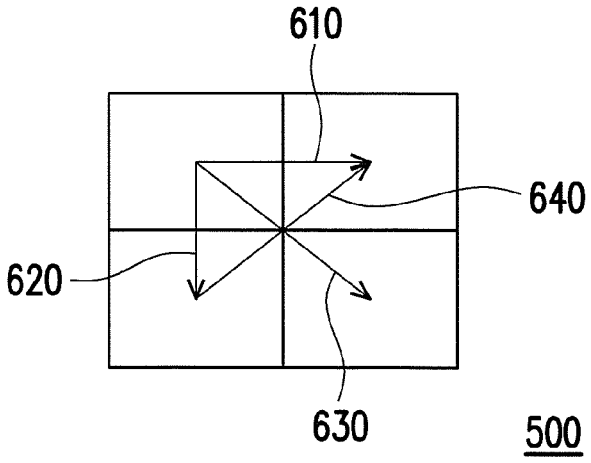

As shown in FIG. 6, in the time-frequency domain 500, the processor 140 may calculate the differences between the adjacent magnitudes in the time-frequency domain 500 by using a direction 610 (i.e., a horizontal direction) and a direction 620 (i.e., a vertical direction) orthogonal to each other. Moreover, the processor 140 may also calculate the differences between the adjacent magnitudes in the time-frequency domain 500 by using a direction 630 and a direction 640 orthogonal to each other. In the present embodiment, the direction 610 is determined by a direction along which the time is increased, the direction 620 is determined by a direction along which the frequency is increased, the direction 630 is determined by a direction along which the frequency is increased and the time is increased, and the direction 640 is determined by a direction along which the time is increased and the frequency is decreased. An included angle between the direction 630 and the direction 610 is 45 degrees.

In the present embodiment, regarding the direction 610 and the direction 620 orthogonal to each other, the processor 140 may calculate the adjacent magnitudes in the direction 610 in pairs to obtain a plurality of gradient components Gradient_LR in the direction 610, and accumulates the gradient components Gradient_LR to obtain the difference value of the magnitudes in the time-frequency domain 500 in the direction 610. Moreover, the processor 140 may calculate the adjacent magnitudes in the direction 620 in pairs to obtain a plurality of gradient components Gradient_UD in the direction 620, and accumulates the gradient components Gradient_UD to obtain the difference value of the magnitudes in the time-frequency domain 500 in the direction 620.

Moreover, regarding the direction 630 and the direction 640 orthogonal to each other, the processor 140 may calculate the adjacent magnitudes in the direction 630 in pairs to obtain a plurality of gradient components Gradient_LuRd in the direction 630, and accumulates the gradient components Gradient_LuRd to obtain the difference values of the magnitudes in the time-frequency domain 500 in the direction 630. Moreover, the processor 140 may calculate the adjacent magnitudes in the direction 640 in pairs to obtain a plurality of gradient components Gradient_LdRu in the direction 640, and accumulates the gradient components Gradient_LdRu to obtain the difference values of the magnitudes in the time-frequency domain 500 in the direction 640.

In the present embodiment, the aforementioned operation of accumulating the gradient components to obtain the difference values of the magnitudes in each of the directions may includes following two steps S422 and S424. Taking the direction 610 as an example, the steps S422 and S424 are described with reference of the schematic diagram of FIG. 7. In the step S422, the processor 140 first accumulates the gradient components in the direction 610 along which the time is increased. For example, corresponding to the spectrum component $I_0$, the processor 140 accumulates the gradient components Gradient_$LR_1$ to Gradient to obtain an operation result $GR_0$.

Moreover, regarding the other spectrum components (for example, the spectrum components $I_1$, $I_2$, . . . ), the processor 140 also obtains the operation results (for example, operation results $GR_1$, $GR_2$, . . . ) corresponding to the aforementioned spectrum components through the similar operation method. Taking the m×k time-frequency domain 500 including k spectrum components as an example, after the step S422 is completed, the processor 140 obtains k operation results $GR_0$-$GR_{k-1}$. Then, in step S424, the processor 140 again accumulates the k operation results $GR_0$ to $GR_{k-1}$ in the direction along which the frequency is increased. In this way, the difference value Diff_LR of the magnitudes in the time-frequency domain 500 in the direction 610 is obtained. Similarly, the processor 140 may respectively calculate the difference values of the magnitudes in the time-frequency domain 500 in the directions 620, 630 and 640 according to the above flow.

Then, in step S430, the processor 140 determines the maximum degree of difference of the magnitudes in the time-frequency domain 500 according to the above difference values. The step S430 may also be divided into steps S432, S434, S436 and S438. The processor 140 may take two directions orthogonal to each other in the at least two directions as a direction combination, for example, takes the directions 610 and 620 as a first direction combination, and takes the directions 630 and 640 as a second direction combination. In each of the direction combinations, the processor 140 compares the difference values in the two direction orthogonal to each other to obtain a maximum proportion corresponding to each of the direction combinations (step S436), and sets a sum of the maximum proportions to be the maximum degree of difference according to a plurality of the maximum proportions corresponding to the direction combinations (step S438).

Particularly, in the step S420, when the processor 140 calculates the differences in the time-frequency domain 500, the processor 140 may further divide the audio frames $F_1$ to $F_m$ into two sets according to a sampling time sequence while taking a sampling time corresponding to the target frame $F_c$ as a boundary, such that regarding a part of the magnitudes of the time-frequency domain 500 corresponding to each of the above sets, the processor 140 calculates differences between the adjacent magnitudes in the above part, and finds a proportion corresponding to each set in each of the direction combinations, so as to find the maximum proportion.

Further, the processor 140, for example, takes the audio frames $F_1$ to $F_c$ as a first set, and calculates the difference values of the first set in the directions 610 and 620 orthogonal to each other, and calculates the difference values of the first set in the directions 630 and 640 orthogonal to each other. Moreover, the processor 140, for example, takes the audio frames $F_c$ to $F_m$ as a second set, and calculates the difference values of the second set in the directions 610 and 620 orthogonal to each other, and calculates the difference values of the second set in the directions 630 and 640 orthogonal to each other. In other words, regarding the part of the magnitudes corresponding to each of the sets, the processor 140 may calculate differences between the adjacent magnitudes in the above part, so as to obtain the difference values respectively corresponding to each of the above sets in the aforementioned two directions orthogonal to each other in the aforementioned direction combinations.

Figure 7:
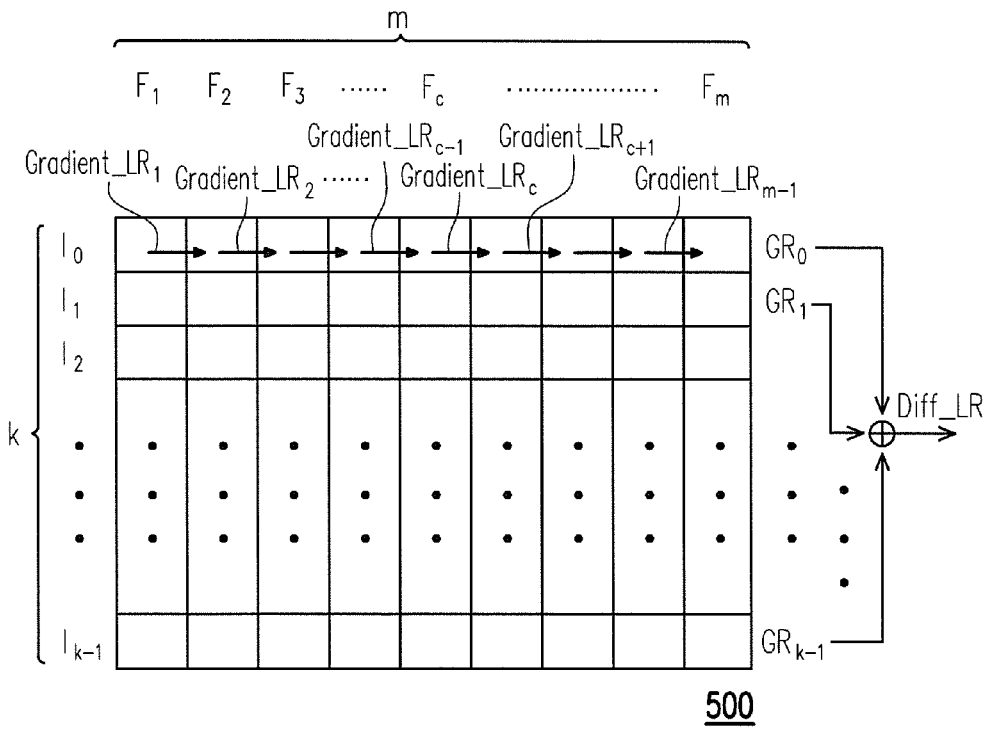

Taking FIG. 7 as an example, the processor 140 accumulates the gradient components $Gradient_LR_1$ to $Gradient_LR_{c-1}$ to obtain the operation result corresponding to the first set in the direction 610, and accordingly calculates the difference value $Diff_LR_1$. Moreover, the processor 140 accumulates the gradient components $Gradient_LR_c$ to $Gradient_LR_{m-1}$ to obtain the operation result corresponding to the second set in the direction 610, and accordingly calculates the difference value $Diff_LR_2$. Similarly, according to the above flow, the processor 140 may respectively calculate the difference values $Diff_UD_1$, $Diff_LuRd_1$, $Diff_LdRu_1$ of the first set in the directions 620, 630 and 640, and the difference values $Diff_UD_2$, $Diff_LuRd_2$, $Diff_LdRu_2$ of the second set in the directions 620, 630 and 640, and since operation details thereof are similar to that of the aforementioned embodiment, details thereof are not repeated.

Then, the processor 140 compares the difference values of each set corresponding to each of the aforementioned direction combinations to obtain a maximum value and a minimum value (step S432), and calculates the maximum value and the minimum value to obtain a proportion corresponding to each of the aforementioned direction combinations of each set (step S434), and compares the proportions respectively corresponding to the sets in each of the aforementioned direction combinations, so as to set the maximum one of the proportions as a maximum proportion corresponding to the direction combination (step S436).

Therefore, after the step S436, the processor 140 obtains the maximum proportion R1 corresponding to the first direction combination and the maximum proportion R2 corresponding to the second direction combination, and in step S438, the processor 140 calculates a sum R1+R2 of the maximum proportions R1 and R2 to serve as an output. The sum R1+R2 may be regarded as the maximum degree of difference between the magnitudes in the time-frequency domain 500, which corresponds to a first degree of difference RD1 obtained after the processor 140 executes the step S350 of FIG. 3.

It should be noticed that considering different SNRs, if the spectrum information of the audio signal 300 in a lower frequency domain resolution is obtained to compare with the spectrum information in the time-frequency domain 500, a situation that the signal is spoiled by the noise in case of the low SNR is mitigated, which avails improving the accuracy of noise detection. Therefore, referring back to the flow of FIG. 3, in step S362, the processor 140 may further execute a 2D low-pass filtering operation to the magnitudes in the time-frequency domain, so as to obtain a second time-frequency domain, and in step S364, the processor 140 stores the magnitudes in the second time-frequency domain into the storage device 120 (in FIG. 3, only the spectrum information SI_2 corresponding to one of the audio frames is illustrated for indication). Similarly, the magnitudes of the second time-frequency domain may be stored to another ring buffer in the storage device 120. Then, in step S366, the processor 140 determines the maximum degree of difference in the second time-frequency domain according to the differences between the adjacent magnitudes in the second time-frequency domain. In other words, in the step S366, the processor 140 performs a spectrum difference analysis to the target frame $F_c$ according to another resolution. A detailed flow of the step S366 is similar to the flow of the step S350 and the flow of FIG. 4, which is not repeated.

According to the above descriptions, if the processor 140 obtains the maximum degree of difference of the time-frequency domain to be the first degree of difference RD1 after executing the step S350, and obtains the maximum degree of difference of the second time-frequency domain to be the second degree of difference RD2 after executing the step S366, in step S370, the processor 140 compares the first degree of difference RD1 and the second degree of difference RD2 to set a larger one of the first degree of difference RD1 and the second degree of difference RD2 as the maximum degree of difference MRD.

Then, in step S380, the processor 140 determines whether the maximum degree of difference MRD is lower than a threshold THR. If the maximum degree of difference MRD is lower than the threshold THR, in step S382, the processor 140 determines that the part of the audio signal 300 corresponding to the target frame $F_c$ is the noise. On the other hand, if the maximum degree of difference MRD is not lower than the threshold THR, in step S384, the processor 140 determines that the part of the audio signal 300 corresponding to the target frame $F_c$ is a valid signal. Then, the processor 140 may update the target frame $F_c$ and repeats the step flow of FIG. 3, so as to detect whether the parts of the audio signal 300 corresponding to the other audio frames are noises.

It should be noticed that in an embodiment, the processor 140 may detect whether the target frame $F_c$ is the noise only according to the magnitudes of the time-frequency domain stored in the storage device 120 in the step S340. Therefore, the processor 140 may directly set the first degree of difference RD1 obtained in the step S350 as the maximum degree of difference MRD of the spectrum information of the target frame $F_c$, and executes the follow-up step S380.

Moreover, in another embodiment, the step S350 may be omitted, and the processor 140 may perform the noise detection only according to the magnitudes of the second time-frequency domain obtained through the 2D low-pass filtering operation. Similarly, in the present embodiment, the step S370 may be omitted, and the processor 140 may directly set the second degree of difference RD2 obtained in the step S366 as the maximum degree of difference MRD of the spectrum information of the target frame $F_c$, and executes the follow-up step S380.

It should be noticed that in an embodiment, the processor 140 may calculate the difference values between the adjacent magnitudes according to the two directions orthogonal to each other in a single direction combination. For example, the direction combination includes the direction 610 and the direction 620 orthogonal to each other, in the steps S422, S424, S432, S434, S436 of FIG. 4, the calculations of the difference values and the maximum proportion related to the directions 630 and the direction 640 of the second direction combination may be omitted, and the step S438 of comparing the maximum proportions of the direction combinations may also be omitted.

Therefore, if a first direction and a second direction are used for representing the two directions orthogonal to each other in the aforementioned single direction combination, in the present embodiment, the processor 140 may calculate the adjacent magnitudes in the first direction in pairs to obtain a plurality of gradient components in the first direction, and accumulates the gradient components in the first direction to obtain the difference values in the first direction, and calculate the adjacent magnitudes in the second direction in pairs to obtain a plurality of gradient components in the second direction, and accumulates the gradient components in the second direction to obtain the difference values in the second direction. Thereafter, the processor 140 compares the difference values to obtain the maximum value and the minimum value in the difference values, and calculates a proportion of the maximum value and the minimum value, so as to directly obtain the maximum degree of difference between the magnitudes of the time-frequency domain.

Regarding the aforementioned embodiment, the processor 140 may also divide the audio frames into two sets according to a sampling time sequence while taking a sampling time corresponding to the audio frame as a boundary, such that regarding a part of the magnitudes of the time-frequency domain 500 corresponding to each of the above sets, the processor 140 calculates differences between the adjacent magnitudes in the above part, and finds a proportion corresponding to each set in each of the direction combination, so as to find the maximum proportion. This part is similar to that of the aforementioned embodiment, and details thereof are not repeated.

On the other hand, in an embodiment, in the step S420, the processor 140 may also divide the audio frames $F_1$ to $F_m$ into two or more sets different with that of the aforementioned embodiment according to other dividing rules, so as to calculate differences between the adjacent magnitudes in a part of the magnitudes of the time-frequency domain 500 corresponding to each of the above sets. The above dividing rule may be determined by the number of the audio frames, the sampling time of the audio frames or the spectral component of sampling each of the audio frames, which may be adaptively adjusted according to an actual design requirement or an overall computation amount.

In other embodiments, the step S420 may be adaptively adjusted. In an embodiment, a sequence of the steps S422 and S424 may be exchanged. Namely, the processor 140 of the present embodiment may first accumulates the gradient components in the direction along which the frequency is increased, and then accumulates the operation results in the direction along which the time is increased, so as to obtain the difference values of the magnitudes in the time-frequency domain in such direction. The aforementioned direction along which the frequency is increased and the direction along which the time is increased are only an example, and implementation of the aforementioned accumulation operation is not limited by the invention, and as long as the variations between the adjacent magnitudes in the time-frequency domain are counted to serve as a reference for determining the noise, it is considered to cope with the spirit of the invention.

In summary, in the embodiments of the invention, simple operation instructions can be used to convert the audio signals to the frequency domain, and according to the spectrum information in the time-frequency domain, the magnitude variations in the orthogonal directions are calculated to find the maximum degree of difference. Then, based on the characteristic that the energy of the background noise is almost the same on each frequency band of the spectrum, it is detected whether the part of the audio signal corresponding to the target frame is the noise. Therefore, the noise segment in the audio signal can be effectively found, and a computation amount is decreased, and especially in case that the background noise is changed dramatically, the noise detection can still be effectively implemented. Moreover, detection accuracy is enhanced by using the detecting method of multiple frequency resolution.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A method for detecting noise of audio signals, comprising:

converting an audio signal into a plurality of audio frames, wherein the audio frames are arranged in a chronological order while taking a target frame as a center;

calculating a plurality of magnitudes respectively corresponding to a plurality of spectral components of each of the audio frames;

calculating differences between the adjacent magnitudes in a time-frequency domain to obtain a plurality of difference values in at least two directions orthogonal to each other in the time-frequency domain, wherein the time-frequency domain is defined by the audio frames;

determining a maximum degree of difference of the magnitudes in the time-frequency domain according to the difference values; and determining whether a part of the audio signal corresponding to the target frame is a noise according to the maximum degree of difference.

2. The method for detecting noise of audio signals as claimed in claim 1, wherein a time axis of the time-frequency domain is determined according to a time sequence of sampling the audio frames, and a frequency axis of the time-frequency domain is determined according to the spectral components of sampling the audio frames.

3. The method for detecting noise of audio signals as claimed in claim 1, wherein the at least two directions comprise a first direction and a second direction, and the step of obtaining the difference values in the at least two directions orthogonal to each other in the time-frequency domain comprises:

calculating the adjacent magnitudes in the first direction in pairs to obtain a plurality of gradient components in the first direction;

accumulating the gradient components in the first direction to obtain the difference value in the first direction;

calculating the adjacent magnitudes in the second direction in pairs to obtain a plurality of gradient components in the second direction; and accumulating the gradient components in the second direction to obtain the difference value in the second direction.

4. The method for detecting noise of audio signals as claimed in claim 3, wherein the step of determining the maximum degree of difference of the magnitudes in the time-frequency domain according to the difference values comprises:

comparing the difference values to obtain a maximum value and a minimum value in the difference values; and calculating a proportion of the maximum value and the minimum value to obtain the maximum degree of difference.

5. The method for detecting noise of audio signals as claimed in claim 3, wherein the audio frames are divided into two sets according to a sampling time sequence while taking a sampling time corresponding to the target frame as a boundary, and the step of obtaining the difference values in the at least two directions orthogonal to each other in the time-frequency domain further comprises:

calculating differences between the adjacent magnitudes in a part of the magnitudes corresponding to each of the sets, so as to obtain the difference values of each set in the at least two directions orthogonal to each other.

6. The method for detecting noise of audio signals as claimed in claim 5, wherein the step of determining the maximum degree of difference of the magnitudes in the time-frequency domain according to the difference values comprises:

comparing the difference values of each of the sets in the at least two directions orthogonal to each other to obtain a maximum value and a minimum value in the difference values of each set;

calculating a proportion of the maximum value and the minimum value of each set; and comparing the proportions respectively corresponding to the sets, so as to set the maximum proportion as the maximum degree of difference.

7. The method for detecting noise of audio signals as claimed in claim 3, wherein the at least two directions further comprise a third direction and a fourth direction, wherein the third direction and the fourth direction are orthogonal to each other, and an included angle between the third direction and the first direction is 45 degrees, and the step of obtaining the difference values according to the differences between the adjacent magnitudes further comprises:

calculating the adjacent magnitudes in the third direction in pairs to obtain a plurality of gradient components in the third direction;

accumulating the gradient components in the third direction to obtain the difference value in the third direction;

calculating the adjacent magnitudes in the fourth direction in pairs to obtain a plurality of gradient components in the fourth direction; and accumulating the gradient components in the fourth direction to obtain the difference value in the fourth direction.

8. The method for detecting noise of audio signals as claimed in claim 7, wherein the step of determining the maximum degree of difference of the magnitudes in the time-frequency domain according to the difference values comprises:

taking the two directions orthogonal to each other in the at least two directions as a direction combination;

in each of the direction combinations, obtaining a maximum proportion corresponding to each of the direction combinations by comparing the difference values in the two directions orthogonal to each other; and setting a sum of the maximum proportions respectively corresponding to the direction combinations as the maximum degree of difference.

9. The method for detecting noise of audio signals as claimed in claim 8, wherein the audio frames are divided into two sets according to a sampling time sequence while taking a sampling time corresponding to the target frame as a boundary, and the step of obtaining the maximum proportion corresponding to each of the direction combinations by comparing the difference values in the two directions orthogonal to each other comprises:

calculating differences between the adjacent magnitudes in a part of the magnitudes corresponding to each of the sets, so as to obtain the difference values of each set in the at least two directions orthogonal to each other in each of the direction combinations;

comparing the difference values corresponding to each of the direction combinations of each of the sets to obtain a maximum value and a minimum value;

calculating the maximum value and the minimum value to obtain a proportion corresponding to each of the direction combinations of each of the sets; and comparing the proportions respectively corresponding to the sets in each of the direction combinations, so as to set a maximum one of the proportions as the maximum proportion corresponding to the direction combination.

10. The method for detecting noise of audio signals as claimed in claim 1, wherein the step of determining whether the part of the audio signal corresponding to the target frame is the noise according to the maximum degree of difference comprises:

determining that the part of the audio signal corresponding to the target frame is the noise when the maximum degree of difference is lower than a threshold.

11. The method for detecting noise of audio signals as claimed in claim 1, further comprising:

executing a two-dimensional low-pass filtering operation to the magnitudes in the time-frequency domain, so as to obtain a second time-frequency domain; and determining a maximum degree of difference in the second time-frequency domain according to differences between the adjacent magnitudes in the second time-frequency domain.

12. The method for detecting noise of audio signals as claimed in claim 11, wherein the maximum degree of difference of the time-frequency domain is a first degree of difference, and the maximum degree of difference of the second time-frequency domain is a second degree of difference, and the step of determining whether the part of the audio signal corresponding to the target frame is the noise according to the maximum degree of difference comprises:

comparing the first degree of difference and the second degree of difference, so as to set a larger one of the first degree of difference and the second degree of difference as the maximum degree of difference.

13. An apparatus for detecting noise of audio signals, comprising:

a storage device; and a processor, coupled to the storage device, converting an audio signal into a plurality of audio frames, wherein the audio frames are arranged in a chronological order while taking a target frame as a center, calculating a plurality of magnitudes respectively corresponding to a plurality of spectral components of each of the audio frames, and stores the magnitudes to the storage device, calculating differences between the adjacent magnitudes in a time-frequency domain to obtain a plurality of difference values in at least two directions orthogonal to each other in the time-frequency domain, wherein the time-frequency domain is defined by the audio frames, determining a maximum degree of difference of the magnitudes in the time-frequency domain according to the difference values, and determining whether a part of the audio signal corresponding to the target frame is a noise according to the maximum degree of difference.

14. The apparatus for detecting noise of audio signals as claimed in claim 13, wherein a time axis of the time-frequency domain is determined according to a time sequence of sampling the audio frames, and a frequency axis of the time-frequency domain is determined according to the spectral components of sampling the audio frames.

15. The apparatus for detecting noise of audio signals as claimed in claim 13, wherein the at least two directions comprise a first direction and a second direction, and the processor calculates the adjacent magnitudes in the first direction in pairs to obtain a plurality of gradient components in the first direction, accumulates the gradient components in the first direction to obtain the difference value in the first direction; and calculates the adjacent magnitudes in the second direction in pairs to obtain a plurality of gradient components in the second direction, and accumulates the gradient components in the second direction to obtain the difference value in the second direction.

16. The apparatus for detecting noise of audio signals as claimed in claim 15, wherein the processors compares the difference values to obtain a maximum value and a minimum value in the difference values, and calculates a proportion of the maximum value and the minimum value to obtain the maximum degree of difference.

17. The apparatus for detecting noise of audio signals as claimed in claim 15, wherein the audio frames are divided into two sets according to a sampling time sequence while taking a sampling time corresponding to the target frame as a boundary, and the processor calculates differences between the adjacent magnitudes in a part of the magnitudes corresponding to each of the sets, so as to obtain the difference values of each set in the at least two directions orthogonal to each other.

18. The apparatus for detecting noise of audio signals as claimed in claim 17, wherein the processor compares the difference values of each of the sets in the at least two directions orthogonal to each other to obtain a maximum value and a minimum value in the difference values of each set, calculates a proportion of the maximum value and the minimum value of each set, and compares the proportions respectively corresponding to the sets, so as to set the maximum proportion as the maximum degree of difference.

19. The apparatus for detecting noise of audio signals as claimed in claim 15, wherein the at least two directions further comprise a third direction and a fourth direction, wherein the third direction and the fourth direction are orthogonal to each other, and an included angle between the third direction and the first direction is 45 degrees, and the processor calculates the adjacent magnitudes in the third direction in pairs to obtain a plurality of gradient components in the third direction, accumulates the gradient components in the third direction to obtain the difference value in the third direction; and calculates the adjacent magnitudes in the fourth direction in pairs to obtain a plurality of gradient components in the fourth direction, and accumulates the gradient components in the fourth direction to obtain the difference value in the fourth direction.

20. The apparatus for detecting noise of audio signals as claimed in claim 19, wherein the processor takes the two directions orthogonal to each other in the at least two directions as a direction combination, in each of the direction combinations, the processor obtains a maximum proportion corresponding to each of the direction combinations by comparing the difference values in the two directions orthogonal to each other, and sets a sum of the maximum proportions respectively corresponding to the direction combinations as the maximum degree of difference.

21. The apparatus for detecting noise of audio signals as claimed in claim 20, wherein the audio frames are divided into two sets according to a sampling time sequence while taking a sampling time corresponding to the target frame as a boundary, and the processor calculates differences between the adjacent magnitudes in a part of the magnitudes corresponding to each of the sets, so as to obtain the difference values of each set in the at least two directions orthogonal to each other in each of the direction combinations, the processor compares the difference values corresponding to each of the direction combinations of each of the sets to obtain a maximum value and a minimum value, calculates the maximum value and the minimum value to obtain a proportion corresponding to each of the direction combinations of each of the sets, and compares the proportions respectively corresponding to the sets in each of the direction combinations, so as to set a maximum one of the proportions as the maximum proportion corresponding to the direction combination.

22. The apparatus for detecting noise of audio signals as claimed in claim 13, wherein the processor determines that the part of the audio signal corresponding to the target frame is the noise when the maximum degree of difference is lower than a threshold.

23. The apparatus for detecting noise of audio signals as claimed in claim 13, wherein the processor further executes a two-dimensional low-pass filtering operation to the magnitudes in the time-frequency domain, so as to obtain a second time-frequency domain, stores the magnitudes in the second time-frequency domain into the storage device, and determines a maximum degree of difference in the second time-frequency domain according to differences between the adjacent magnitudes in the second time-frequency domain.

24. The apparatus for detecting noise of audio signals as claimed in claim 23, wherein the maximum degree of difference of the time-frequency domain is a first degree of difference, and the maximum degree of difference of the second time-frequency domain is a second degree of difference, and the processor compares the first degree of difference and the second degree of difference, so as to set a larger one of the first degree of difference and the second degree of difference as the maximum degree of difference.

* * * * *